US005387032A

United States Patent [19]

Reisbeck

[11] Patent Number: 5,387,032

[45] Date of Patent: Feb. 7, 1995

[54] CLOSING MECHANISM FOR CABINETS WITH DRAWERS

[75] Inventor: Günter Reisbeck, Nagold, Germany

[73] Assignee: Hafele GmbH & Co.

[21] Appl. No.: 50,522

[22] Filed: Apr. 20, 1993

[30] Foreign Application Priority Data

Apr. 25, 1992 [DE] Germany ..... 9205640[U]

[51] Int. Cl.[6] ..... E05C 17/10

[52] U.S. Cl. ..... 312/221; 312/217

[58] Field of Search ..... 312/221, 217, 218, 222

[56] References Cited

U.S. PATENT DOCUMENTS

| | | | |
|---|---|---|---|
| 3,404,929 | 10/1968 | Wright | 312/218 |
| 3,888,558 | 6/1975 | Himsl | 312/221 |
| 3,969,008 | 7/1976 | Pergler | 312/221 |
| 4,838,624 | 6/1989 | Walla | 312/221 |
| 4,925,257 | 5/1990 | Frederikson | 312/221 |

FOREIGN PATENT DOCUMENTS

| | | | |
|---|---|---|---|
| 3633256 | 3/1988 | Germany | 312/221 |

*Primary Examiner*—James R. Brittain
*Assistant Examiner*—David E. Allred
*Attorney, Agent, or Firm*—Friedrich Kueffner

[57] ABSTRACT

A closing mechanism for cabinets having a plurality of drawers includes vertically displaceable closing rods and cam pieces mounted on the sides of the drawers. Each closing rod has pins projecting toward the drawers. The cam pieces are provided with stop members which interact with the pins. A holding device serves to hold the closing rods in a displaced position. Each cam piece has an initially obliquely ascending guide surface which is integrated in the cam piece. The cam pieces are arranged at different distances from the closing rods, and the cam pieces of each drawer are arranged differently. The cam pieces and the stop members are mounted so as to be displaceable in longitudinal direction of the sides of the drawers. The cam pieces can be clamped in the selected positions relative to the closing rods.

13 Claims, 2 Drawing Sheets

CLOSING MECHANISM FOR CABINETS WITH DRAWERS

BACKGROUND OF THE INVENTION

1. Field of the Invention

The present invention relates to a closing mechanism for cabinets having drawers.

2. Description of the Related Art

In large cabinets with drawers, for example, dressers or file cabinets, the center of gravity of the cabinet may be shifted outside of the base area of the cabinet, and the cabinet may tilt over if several doors of the cabinet are opened simultaneously. For this reason, it should not be possible to open two or more drawers successively or simultaneously.

A closing mechanism, in which the simultaneous opening of several drawers and the opening of additional drawers are prevented when a drawer is already open, is known in the art. In this closing mechanism, cam pieces are mounted on the drawers, and the cabinet is provided with vertically displaceable closing rods which are arranged next to the drawers and are provided with projecting pins. The closing mechanism further includes a holding device for holding each closing rod in its displaced position. Stop members interacting with the pins are provided for the cam pieces. As soon as a pin enters the cam piece when a drawer is opened, the pin, and consequently the closing rod, are raised by an obliquely ascending guide surface of the cam piece, so that the other pins of the closing rod are moved in front of the stop surfaces of the remaining drawers, and the remaining drawers cannot be opened. In order to additionally prevent a simultaneous opening of several drawers, the cam pieces are arranged at various distances from the closing rod, and the cam pieces are arranged differently in each drawer. Thus, even if two drawers are pulled out simultaneously, the drawer in which the cam piece is mounted more toward the closing rod causes all those drawers to be locked in which the cam piece is arranged at a greater distance from the closing rod. Accordingly, the second drawer or any additional drawers can only be opened by a small distance which corresponds to the distance of the stop surface from the front edge of the drawer. In no event is it possible to pull out the other drawers completely.

SUMMARY OF THE INVENTION

Therefore, it is the primary object of the present invention to simplify the manufacture of the drawers of the above-described cabinet and to simplify the adjustment of the distances relative to the closing rods.

The closing mechanism according to the present invention includes cam pieces which are mounted on the drawers. At least one vertically displaceable closing rod is mounted next to the drawers. The closing rod has projecting pins which interact with stop members provided on the cam pieces. A holding device is provided for holding the closing rod in its displaced position. An initially obliquely ascending guide surface is integrated in the cam piece. The cam pieces are arranged at different distances from the closing rod, and the cam pieces are arranged in a different manner in each drawer. In accordance with the present invention, the cam pieces and the stop members are mounted on the drawers, so as to be movable in longitudinal direction and so as to be clampable.

As a result of the configuration according to the present invention, it is not possible to use completely equal cam pieces in all drawers, and when the drawers are manufactured it is not necessary to take into consideration the distance of the cam pieces and the stop members from the front edge of the drawers, so that all drawers can be constructed completely equally.

The cam pieces and stop members are preferably fixedly connected to each other, preferably manufactured integrally as one piece, so that they are inevitably adjusted together.

In accordance with a particularly simple feature of the present invention, the cam pieces are arranged in grooves of the drawer and are clamped in the groove. Another feature of the present invention provides that an eccentric member is arranged for clamping each cam piece, wherein the axis of rotation of the eccentric member extends approximately perpendicularly to the bottom of the groove, and wherein the circumference of the eccentric member rests in at least one position thereof against a side of the groove. After releasing the eccentric member, the cam piece can be displaced within the groove into the desired position, and the cam piece can subsequently be clamped in this position by turning back the eccentric member.

In accordance with another particularly simple feature, on the side of the cam piece facing the groove bottom is provided a bearing shell for a hub of the eccentric member, wherein the bearing shell is open toward the opposite side, and on a surface directed toward a groove side is provided an opening for the eccentric member. The bearing shell must be open in order to make it possible to adjust the eccentric member from outside of the drawer. In order to prevent unintended loosening of the cam piece, it is advantageous to provide a roughened surface, for example, a ribbed surface, on the side opposite the opening for the eccentric member, or to provide claws at this side.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

DESCRIPTION OF THE PREFERRED EMBODIMENT

Figure 1:
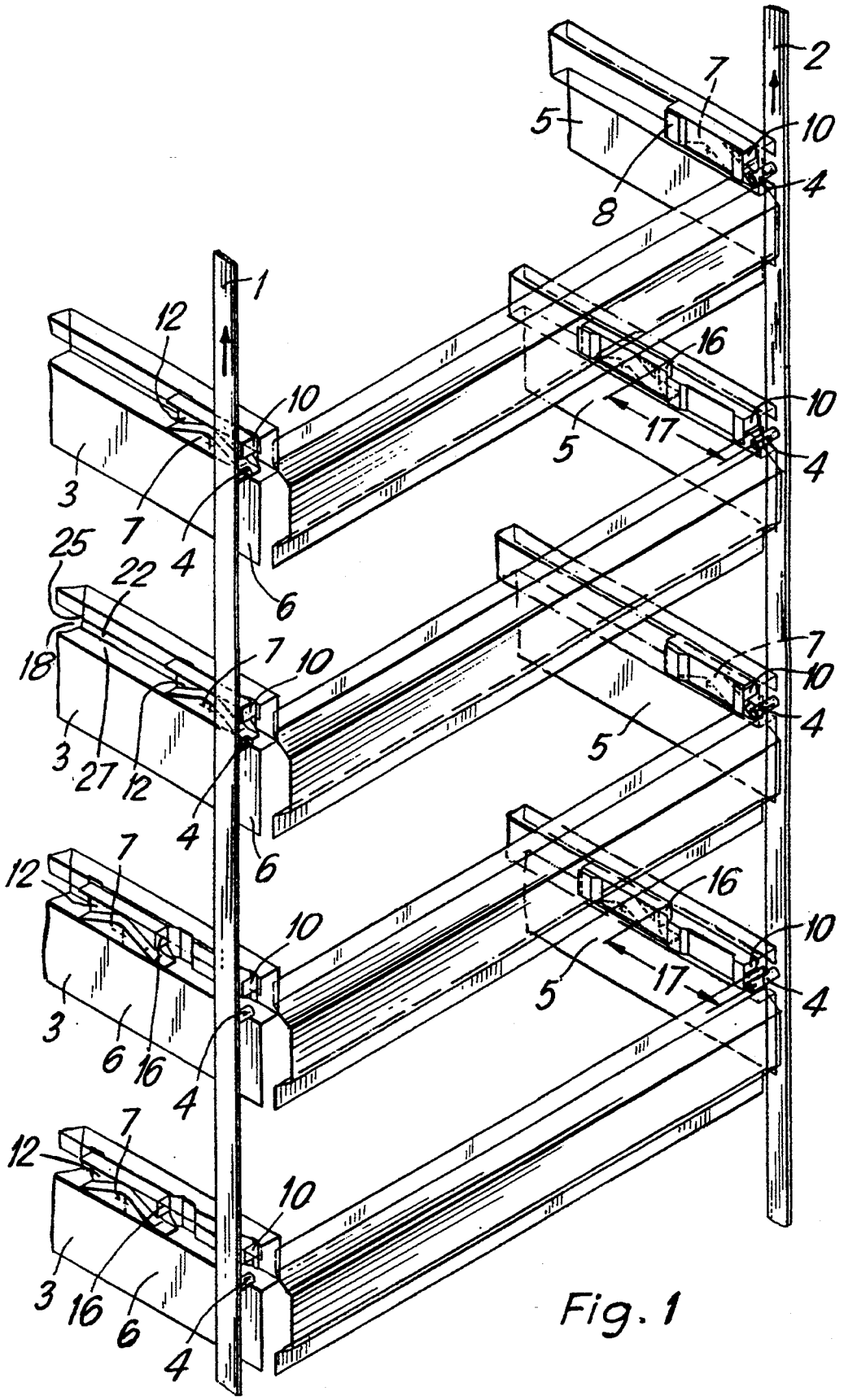
FIG. 1 a partial perspective view of a closing mechanism according to the present invention for a cabinet with four drawers.

FIG. 1 of the drawing shows vertically extending closing rods 1, 2 which are arranged to the left and to the right of the drawers 3. On the sides facing the drawers 3, the closing rods 1, 2 have cylindrical pins 4 which project perpendicularly from the closing rods. Each closing rod 1, 2 has a pin 4 for each drawer 3. A cam piece 7 is arranged on each of the right and left side walls 5, 6 of each drawer 3. A stop surface 10 is provided approximately at the front surface of each side wall 5, 6.

Each cam piece 7 has a restoring surface 13 and a guide surface 14 for guiding the pin 4 and, thus, for deflecting the closing rod 1, 2 when the drawer 3 is pulled out. The restoring surface 13 and the guide surface 14 are connected to each other through a rear wall 15 of the cam piece 7. As seen in longitudinal direction, the guide surface 14 initially extends obliquely upwardly and subsequently extends downwardly to the initial level. The restoring surface 13 initially extends parallel to the guide surface 14, however, after reaching the highest point, the restoring surface 13 extends horizontally to the end of the cam piece 7. A stop member 16 is integrally mounted on the front side of the cam piece 7. The stop member 16 is mounted on the same level as the stop surface 10.

The cam pieces 7 are arranged at different distances from the closing rods 1, 2. In addition, the cam pieces 7 of each drawer 3 are arranged differently as compared to the cam pieces 7 of the other drawers of the cabinet.

The closing mechanism according to the present invention operates as follows.

In the initial position, i.e., when all drawers are closed, the closing rods 1, 2 and the pins 4 thereof are aligned in such a way that the pins 4 are located on the level between the beginning of the guide surface 14 and the restoring surface 13. If one of the drawers 3 is pulled out, the stop surface 10 is moved past the pin 4, and the pin 4 enters the cam piece 7. The obliquely ascending guide surface 14 now moves the closing rod 1, 2 vertically upwardly until it engages a holding device, not shown. In this position, the pins 4 of the closing rods 1, 2 are on the same level as the stop surface 10 or the stop member 16 and, thus, lock the remaining drawers. When the open drawer 3 is pushed back in again, the pin 4 of the closing rod 1, 2 enters the cam piece 7 in the opposite direction. The restoring surface 13 extending parallel to the guide surface 14 now presses the closing rod 1, 2 by means of the pin 4 out of the holding device not shown and moves the closing rod 1, 2 back into the initial position. As a result, all drawers 4 are again unlocked, and any of the drawers 3 can be pulled out.

When two drawers 3 are pulled out simultaneously, the different combinations of the cam pieces 7 at each drawer 3 ensure that one of the drawers 3 is locked at the latest after the drawers have been pulled out by the distance 17. The individual arrangement of the cam pieces 7 at the drawers 3 has the result that the closing rods 1, 2 are deflected in a different combination by each of the drawers and, thus, it is not possible to open two drawers 3 simultaneously.

Figure 3:
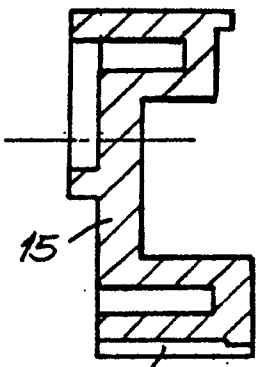
FIG. 3 is a sectional view along sectional line III—III of FIG. 2.
Figure 2:
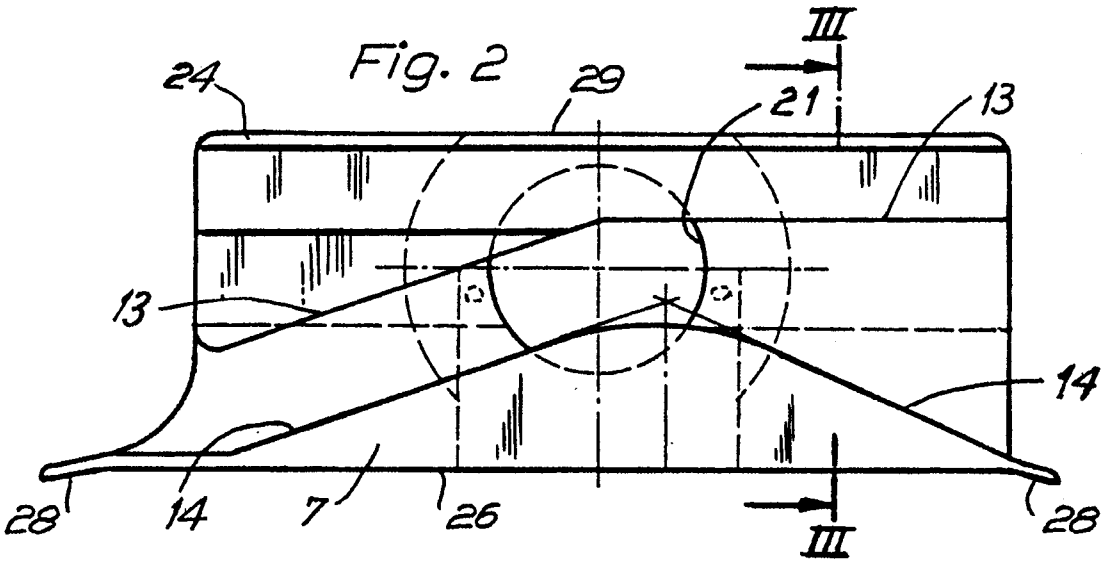
FIG. 2 is a side elevational view, on a larger scale, of a cam piece.
Figure 4:
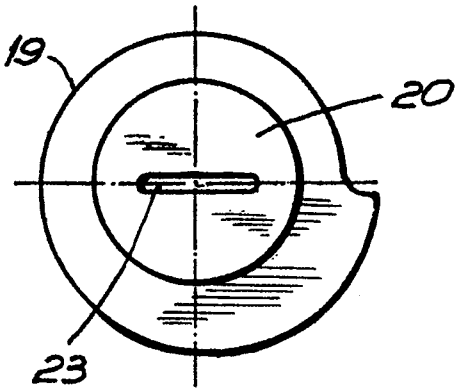
FIG. 4 is a top view of an eccentric member.

The cam pieces 7 are mounted in a displaceable and clampable manner in grooves 18 of the side walls 5, 6 of the drawers. This makes it possible to adjust the position of the cam pieces 7 and of the stop member 16 integrally connected to the cam pieces 7 to any desired location. As shown in FIGS. 2–4, clamping of the cam piece 7 is effected by means of an eccentric member 19 with a hub 20 rotatably mounted in a bearing shell 21 of the rear wall 15 of the cam piece 7. The bearing shell 21 is open toward the outside, so that a tool, particularly a screwdriver, not shown, can be guided therethrough and inserted into the slot 23 of the eccentric member for turning the eccentric member into the desired position. The axis of the bearing shell 21 extends perpendicularly to the bottom 22 of the groove 18. The cam piece 7 has, at the upper side thereof, an opening 29 for the eccentric member 19. When the eccentric member 19 is turned into the appropriate position in which a portion of its circumference projects out of the upper surface 24 of the cam piece 7, the eccentric member 19 rests against the upper side of the groove 25 and presses the bottom side 26 of the cam piece 7 against the lower side 27 of the groove, so that the cam piece 7 is fixed within the groove 18. For securely fastening the cam piece 7, the bottom side 26 of the cam piece 7 is provided with claws 28, particularly at both ends of the bottom side 26.

Because of the displaceable arrangement of the cam pieces 7 with the stop members 16, it is possible to manufacture completely identical drawers, wherein the correct distance of the cam pieces 7 and of the stop members 16 from the pins 4 of the closing rods 1, 2 can be adjusted as desired during the assembly of the drawers.

Figure 5:
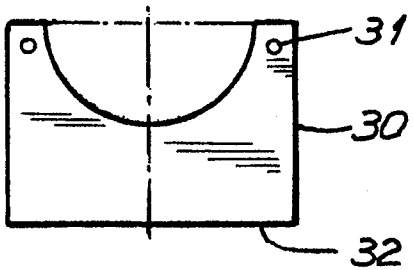
FIG. 5 is a top view of a support plate.

If the cam pieces 7 are manufactured of plastics material, there is the danger that the plastics material yields over time, particularly under the influence of certain temperatures, and the clamping action becomes insufficient. In order to obtain absolute security against any displacement, another feature of the present invention provides that a support plate 30 is mounted between the hub 20 of the eccentric member 19 and the surface 26 of the cam piece 7 located opposite the opening 29 for the eccentric member 19. The support plate 30 is illustrated in FIG. 5 and is indicated in FIG. 2 in broken lines. The support plate 30 may be made of sheet steel. The support plate 30 rests against the rear wall 15 of the cam piece 7 and has projections 31 which are forced into the rear wall 15 and, as a result, produce a connection which is virtually impossible to displace. In order to prevent displacement relative to the lower side 27 of the groove 18, the lower end 32 of the support plate 30 may be toothed.

It should be understood that the preferred embodiment and examples described are for illustrative purposes only and are not to be construed as limiting the scope of the present invention which is properly delineated only in the appended claims.

We claim:

1. A closing mechanism for a cabinet having a plurality of drawers slidable out of the cabinet from a closed position, the drawers having sides, each side having a longitudinal direction, at least one vertically displaceable closing rod being mounted on one of the sides of the drawers, a cam piece mounted on the side of each drawer, the at least one closing rod having pins projecting from the closing rod toward the sides of the drawers the cam piece having an inclined surface for displacing the closing rod into a displaced position when the cam piece is moved past one of the pins of the closing rod, the cam piece comprising a stop member mounted on a level equal to a level of the pin when the closing rod is in the displaced position, the cam piece being displaceable in the longitudinal direction of the side of the drawer and comprising clamping means for clamping the cam piece in a selected position along the longitudinal direction of the side of the drawer, wherein the cam pieces of the plurality of drawers are clamped at positions having different distances from the closing rods when the drawers are in the closed position.

2. The closing mechanism according to claim 1, comprising two closing rods mounted on opposite sides of the drawers, and each drawer having two cam pieces, the cam pieces of each drawer being mounted in different configurations relative to the closing rods.

3. The closing mechanism according to claim 1, wherein the cam piece and the stop member are fixedly connected to each other.

4. The closing mechanism according to claim 1, wherein the cam piece and the stop member are integrally connected.

5. The closing mechanism according to claim 1, wherein each side of each drawer has a groove extending in the longitudinal direction, the cam piece being slidably mounted in the groove, the clamping means clamping the cam piece in the groove.

6. The closing mechanism according to claim 5, wherein each cam piece comprises an eccentric member, the eccentric member having an axis of rotation, the groove having a bottom and two sides, the axis of rotation extending approximately perpendicularly to the bottom of the groove, the eccentric member having a circumference, the eccentric member being rotatable such that the circumference thereof rests, at least in one position of rotation, against one of the sides of the groove.

7. The closing mechanism according to claim 6, wherein each cam piece comprises a bearing shell, the bearing shell being mounted on a side of the cam piece facing the groove bottom, the bearing shell having an opening on a side opposite a side facing the groove bottom, a hub of the eccentric member being received in the bearing shell, the cam piece having surfaces facing the sides of the groove, one of the surfaces facing the sides of the groove having an opening, the eccentric member extending through the opening of the surface.

8. The closing mechanism according to claim 7, wherein the surface of the cam piece opposite the surface with the opening for the eccentric member is a roughened surface.

9. The closing mechanism according to claim 8, wherein the roughened surface comprises ribs.

10. The closing mechanism according to claim 7, wherein the surface of the cam piece opposite the surface with the opening for the eccentric member comprises claws.

11. The closing mechanism according to claim 7, comprising a support plate mounted between the hub of the eccentric member and the surface with the opening for the eccentric member, the cam piece having a rear wall, the support plate being mounted so as to be essentially nondisplaceable relative to the rear wall.

12. The closing mechanism according to claim 11, wherein the support plate is of steel.

13. The closing mechanism according to claim 11, wherein the support plate has a toothing at an end facing away from the hub of the eccentric member.

* * * * *